US008237074B2

(12) United States Patent
Tetik et al.

(10) Patent No.: US 8,237,074 B2
(45) Date of Patent: Aug. 7, 2012

(54) SWITCHING DEVICE

(75) Inventors: Adolf Tetik, Vienna (AT); Roman Kolm, Gr. Reichenbach (AT)

(73) Assignee: Moeller Gebäudeautomation GmbH, Schrems (AT)

( * ) Notice: Subject to any disclaimer, the term of this patent is extended or adjusted under 35 U.S.C. 154(b) by 542 days.

(21) Appl. No.: 12/397,821

(22) Filed: Mar. 4, 2009

(65) Prior Publication Data

US 2009/0223934 A1 Sep. 10, 2009

Related U.S. Application Data

(60) Provisional application No. 61/033,901, filed on Mar. 5, 2008.

(30) Foreign Application Priority Data

Mar. 5, 2008 (AT) ..... A 358/2008

(51) Int. Cl.
*H01H 33/18* (2006.01)

(52) U.S. Cl. ..... 218/34; 218/156

(58) Field of Classification Search ..... 218/34, 218/156

See application file for complete search history.

(56) References Cited

U.S. PATENT DOCUMENTS 7,041,921 B2 5/2006 Kadan et al.

FOREIGN PATENT DOCUMENTS

| | | |
|---|---|---|
| DE | 1 020 094 | 11/1957 |
| DE | 1 290 219 | 3/1969 |
| DE | 31 29 161 A1 | 2/1983 |
| EP | 0 292 850 A2 | 11/1988 |
| EP | 0 621 615 A1 | 10/1994 |

*Primary Examiner* — Truc Nguyen

(74) *Attorney, Agent, or Firm* — Henry M. Feiereisen; Ursula B. Day

(57) ABSTRACT

A switching device has an input terminal and an output terminal for connection to electrical conductors, and two switching contacts which, when closed, close a current path between the input terminal and the output terminal. A disconnect device is operatively connected to at least one of the input terminal and the output terminal for disconnecting the two switching contacts. An arc quenching chamber composed of a plurality of metal plates is arranged in the region of the switching. At least two of the metal plates abut one another at least over a region to attain high reliability and operational safety even after repeated disconnects.

12 Claims, 2 Drawing Sheets

SWITCHING DEVICE

CROSS-REFERENCES TO RELATED APPLICATIONS

This application claims the benefit of prior filed U.S. Provisional Application No. 61/033,901, filed Mar. 5, 2008, pursuant to 35 U.S.C. 119(e).

This application further claims the priority of Austrian Patent Application, Serial No. A 358/2008, filed Mar. 5, 2008, pursuant to 35 U.S.C. 119(a)-(d), The contents of U.S. provisional Application No. 61/033,901 and Austrian Patent Application, Serial No. A 358/2008 are incorporated herein by reference in its entirety as if fully set forth herein.

BACKGROUND OF THE INVENTION

The present invention relates, in general, to a switching device.

The following discussion of related art is provided to assist the reader in understanding the advantages of the invention, and is not to be construed as an admission that this related art is prior art to this invention.

Switching devices of a type involved here disconnect a line network from the power grid in the event of excess currents in the line network lasting for a presettable time, in order to prevent further supply of electric current. There are also switching devices which disconnect a line network from the power grid in the event of a short-circuit to prevent further supply of electric current. These switching devices have therefore a so-called overcurrent trigger device and/or a short-circuit trigger device, which upon actuation trigger a mechanical disconnect device which disconnects the switching contacts of the switching device and prevents further current flow. The overcurrent trigger device and/or a short-circuit trigger device typically operate mechanically on a mechanical trigger of the disconnect device. In addition to triggering the disconnect device with the trigger device, an actuating lever is typically provided which can be used to control the disconnect device for disconnecting the switching contacts.

When the switching contacts are disconnected, an arc is produced between the opening switching contacts due to the physical principle described by the induction law. During a short-circuit in a line network, very high currents in a range between about 5 kA and 25 kA can occur. When a short-circuit causes the switching device to switch off, the switching contacts must disconnect this very high electric current. The produced arc is also very strong and would destroy the switching device without special equipment provided on the switching device. These switching devices therefore have typically a so-called arc quenching chamber which steers the produced arc and removes energy until the arc is extinguished. To this end, the arc quenching chamber has a number of metal plates, which are also referred to as de-ionizing plates. These metal plates, which are typically identical, are in conventional switching devices arranged inside the arc quenching chamber in a uniform pattern and parallel to one another. This has the disadvantage that some of the metal plates are frequently stressed more by an arc than others, which causes the various metal plates inside an arc quenching chamber to wear down differently. As a result, some metal plates may be worn down to a degree where continued operational safety of the switching devices can no longer be ensured. This is even more dangerous because such faults cannot be identified through external visual inspection, so the user may simply assume that the switching device is still operating safely.

It would therefore be desirable and advantageous to provide an improved switching device which obviates prior art shortcomings and is reliable and safe in operation, even after being repeatedly switched off, and which has also low manufacturing costs.

SUMMARY OF THE INVENTION

According to one aspect of the invention, a switching device includes an input terminal and an output terminal for connection to electrical conductors, first and second switching contacts which, when closed, close a current path between the input terminal and the output terminal, a disconnect device operable to disconnect the first switching contact and the second switching contact, and an arc quenching chamber arranged in a region of the first and second switching contacts and having a plurality of metal plates, with at least two of the plurality of metal plates abutting one another at least over a region.

In this way, a switching device can be produced which has high reliability and operational safety even after being repeatedly switched off. With the design of the arc quenching chamber according to the invention, the particularly highly stressed metal plates inside the arc quenching chamber can survive this high stress over a longer operating time without suffering damage, so that even a faulty arc quenching chamber can safely operate without posing a risk. The manufacturing cost can also be kept low by arranging two metal plates with a substantially identical shape side by side, because no additional special parts need to be manufactured and kept in inventory. This approach can prevent burn-off of the most highly stressed metal plates inside the arc quenching chamber.

According to another advantageous feature of the present invention, the first switching contact may be configured as a movable switching contact, and the arc quenching chamber may have a first opening in a first region, with the first switching contact passing through the first opening. The metal plates may be arranged to follow the linear motion of the first switching contact. The second switching contact may be configured as a stationary switching contact, and the arc quenching chamber may be arranged in a region of the second switching contact. The at least two metal plates abutting one another may be located closest to the second switching contact. The spacing between two adjacent metal plates may progressively increase from the first opening to the outlet The metal plates may have a U-shaped recess.

According to another advantageous feature of the present invention, the arc quenching chamber may have a housing formed of a thermoset and at least one outlet for venting ionized gases. The housing may have openings for receiving the metal plates. A closure element may be arranged in the region of the first opening of the arc quenching chamber, with the closure element having a slot and being formed of thermoplastic material. At least one conductor plate may be arranged on each side of the slot and oriented parallel to the slot.

According to another advantageous feature of the present invention, the switching device may be configured as a circuit breaker.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
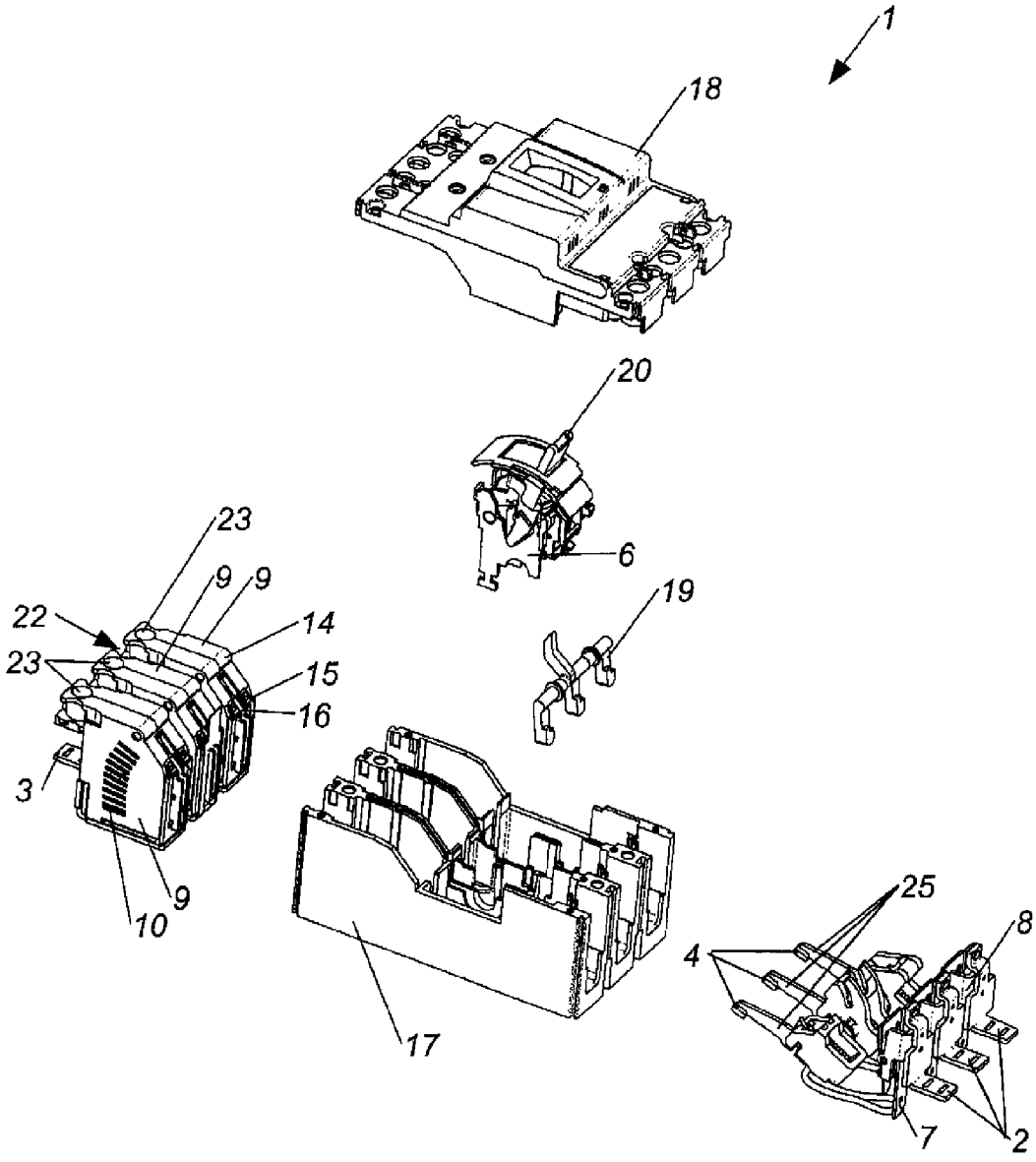
FIG. 1 shows an axonometric exploded view of one embodiment of a switching device according to the invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a switching device, generally designated by reference numeral 1 and configured in particular in the form of a circuit breaker. The switching device 1 has at least one input terminal 2 and at least one output terminal 3 for connecting electrical conductors, and a first switching contact 4 and a second switching contact. When the switching contacts 4 assume a closed position, they close a current path between the input terminal 2 and the output terminal 3. At least one quenching chamber 9 with a predefinable number of metal plates 10 is arranged in the region of the switching contacts 4, wherein at least two of the metal plates 10 are at least in certain regions arranged so as to abut one another.

In this way, a switching device 1 can be produced which has a high reliability and operational safety even after repeatedly being switched off. By designing the arc quenching chamber 9 according to the invention, the particularly highly stressed metal plates 10 inside the arc quenching chamber 9 can survive this high stress over a longer operating time without suffering damage, so that even a faulty arc quenching chamber 9 does not pose any risk. The manufacturing cost can also be kept low by arranging two substantially identically formed metal plates 10 side by side, because no additional special parts need to be produced and kept in inventory. This approach can reliably prevent burn-off of the most highly stressed metal plates 10 inside the arc quenching chamber 9.

FIG. 1 shows a number of components of the switching device 1 by way of an axonometric exploded view. The switching device 1 has three switching paths or current paths, wherein any predeterminable number of switching paths or switchable current paths can be implemented. Preferably, switching devices 1 according to the invention with one, two, three or four current paths are contemplated. The number of input terminals 2 and output terminals 3 is identical to the number of current paths. FIG. 1 illustrates only those parts of the input terminals 2 and the output terminals 3 that are fixed with respect to the housing. Each of the respective input terminals 2 and output terminals 3 typically includes, in addition to the illustrated parts, at least one terminal screw and preferably also a clamping washer moved by the terminal screw.

The switching device 1 includes a housing made of an insulating material, which in the preferred embodiment includes a lower housing shell 17 and an upper housing shell 18. The at least one first switching contact 4 rests in a closed position on the at least one second switching contact, which is in the illustrated embodiment arranged inside the assembly of the arc quenching chamber 9.

The switching device 1 includes an overcurrent trigger device 7 and/or a short-circuit trigger device 8. The short-circuit trigger device 7 is formed of a U-shaped yoke and a hinged armature, wherein the U-shaped yoke is attached to a first conductor of the current path which is preferably associated with the input terminal 2 and/or the output terminal 3. The hinged armature is rotatably supported on the U-shaped yoke and is urged by a hinged-armature spring into a rest position, where the hinged armature is spaced from the U-shaped yoke in the rest position. In the event of a short circuit, the currents through the switching device 1 are sufficient to pull the hinged armature against the U-shaped yoke, thereby deflecting a first end of the hinged armature. The first end of the hinged armature then causes triggering of a disconnect device 6 and hence disconnection of the switching contacts 4.

The overcurrent trigger device 7 includes a bimetallic element which is attached to the first conductor. Current flows directly through the bimetallic element which is therefore part of the current path, and is hence directly heated by the current. Alternatively, the bimetallic element can be indirectly heated, either entirely or additionally, for example by arranging a current-carrying conductor on the bimetallic element. The bimetallic element is progressively distorted with increasing heat-up by the current flow. At a predeterminable distortion of the bimetallic element, which is proportional to a predeterminable heat-up of the line network, the bimetallic element moves the trigger shaft 19 which then triggers the disconnect device 6, and hence also disconnects the switching contacts 4.

The overcurrent trigger device 7 and/or the short-circuit trigger device 8 do not operate directly on the disconnect device 6, but rather by way of a reversing lever, which in the illustrated preferred embodiment is implemented as a trigger shaft 19.

Currently preferred is the implementation of the disconnect device 6 as a switch latch. The switch latch represents a force-storing connecting member between an actuating lever 20 and the switching contacts 4. In the illustrated embodiment, at a first step, the switch latch is biased in a first direction by moving the actuating lever 20, whereby a spring force store is tensioned which quickly and safely disconnects the switching contacts 4 when the switch latch is triggered.

Figure 2:
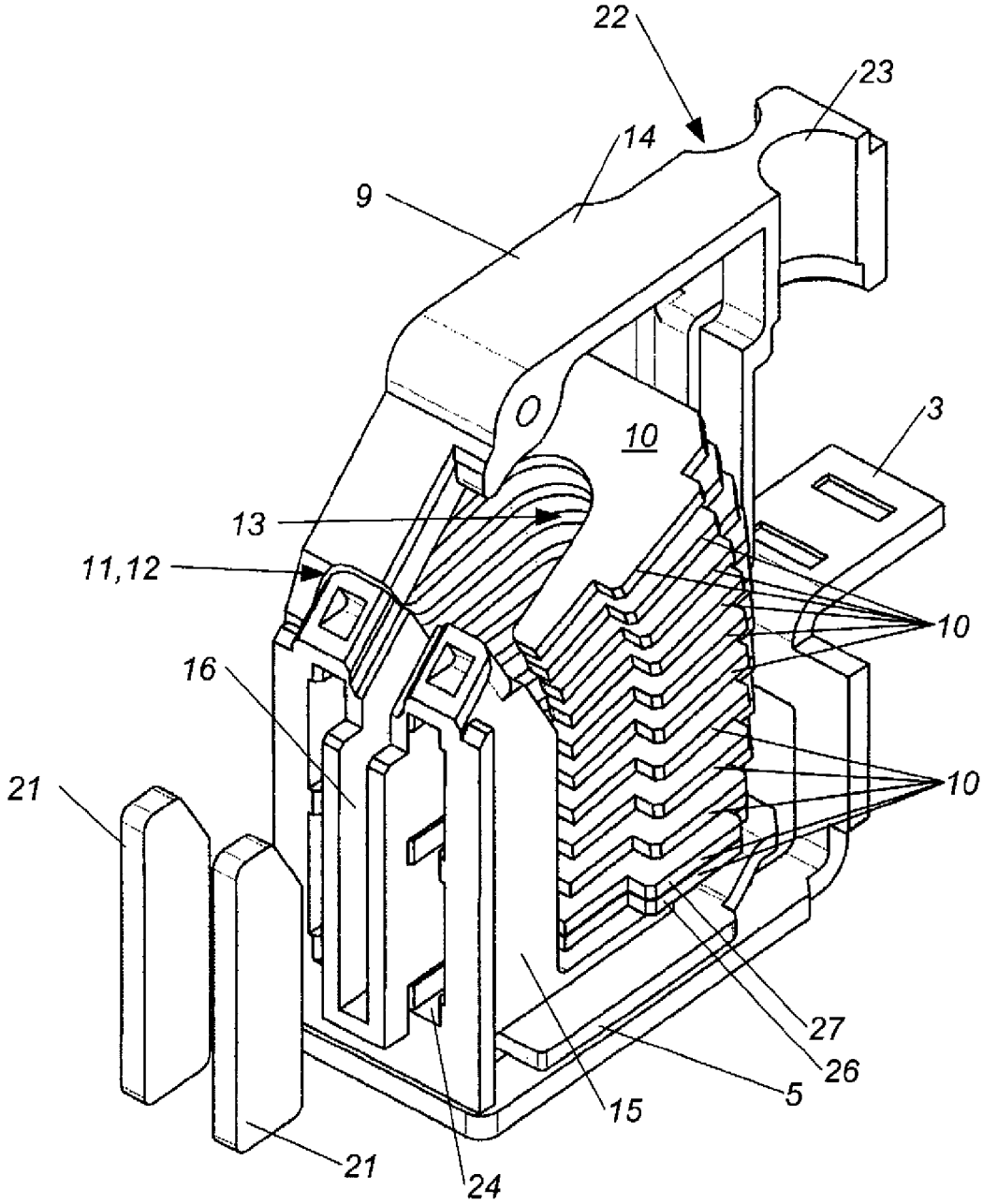
FIG. 2 shows an axonometric view of an arc quenching chamber of the switching device of FIG. 1, with one housing half being omitted.

The switching device 1 has a separate arc quenching chamber 9 for each pair of switching contacts 4, i.e., for each pair of at least one switching contact 4 affixed to the housing and at least one movable switching contact 4 associated with the same switching path or switching the same switching path. A predefinable number of metal plates, which are preferably made of a heat resistant metal, in particular a metal comprising steel, is arranged in each arc quenching chamber 9. A currently preferred embodiment of the arc quenching chamber 9 is illustrated in detail in FIG. 2 and has a two-part housing 14 made of an insulating material, preferably from a thermoses. In the illustration of FIG. 2, one of the two housing parts has been removed to show the interior construction of the arc quenching chamber 9. In the housing 14, particularly in the individual housing parts, a predefinable number of openings for receiving the metal plates 10 is arranged. This allows a particularly simple construction of an arc quenching chamber 9 according to the invention, wherein the arrangement of the metal plates 10 inside the arc quenching chamber 9 can be freely defined over a wide range, and the individual metal plates, which are supported by a projection in the openings of the housing 14, are securely and permanently anchored, which further increases the operational safety of a switching device 1 according to the invention.

Currently preferred is the implementation of the second switching contact as a stationary switching contact. The arc quenching chamber 9 is arranged in the region of the second switching contact and demarcates the region between the second switching contact and the open position of the first switching contact 4 which is configured as a movable switching contact 4. In the illustration of FIG. 2, the second switching contact is arranged directly above a shield plate 5, which in particular contains iron, and below the metal plates 10, wherein the second switching contact in FIG. 2 is obscured by the metal plates 10. The second switching contact is connected with the output terminal 3, which is looped underneath the arc quenching chamber 9 and terminates in the second switching contact. With the looped configuration of the second switching contact, the high current expected in the event of a short-circuit generates an electromotive force at the second switching contact, which causes the first switching contact 4 to be repulsed by the second switching contact. In this way, disconnection of the first switching contact from the second switching contact 4 can become significantly faster in the event of a short-circuit.

To move or guide the first switching contact 4 inside the arc quenching chamber 9, the arc quenching chamber 9 has a first opening 12 in a first region 11 through which the first switching contact 4 is routed. In this way, a first switching contact 4 is during the opening motion always surrounded by metal plates, which rapidly deflect the arc from the switching contacts. In addition, the U-shape of the metal plates 10 increases the surface area of the metal plates 10, thereby providing effective cooling, so that energy can be quickly removed from the arc, which is then quenched.

According to the invention, at least two of the metal plates 10 abut one another at least in certain regions. More particularly, a second metal plate 10, 27, which at least in certain areas abuts the first metal plate 10, 26, is associated with the first metal plate 10, 26 that is most severely stressed by a switching operation. It has been shown that the two metal plates 10 arranged closest to the second switching contact should advantageously be the two metal plates 10 which abut one another at least in certain regions, as also disclosed with reference to the embodiment of an arc quenching chamber 9 illustrated in FIGS. 1 and 2. In a currently preferred embodiment, the two abutting metal plates have a substantially identically shape and are arranged substantially completely on top of one another. This can reduce the stress on individual metal plates in the immediate vicinity where an arc is generated.

Advantageously, the metal plates 10 are arranged at least in certain areas inside the arc quenching chamber 9 in the shape of a fan, as also illustrated in the embodiments depicted in FIGS. 1 and 2, whereby the arc can be particularly advantageously guided and the ionized gases produced by the arc can be particularly effectively removed by creating an advantageous flow pattern. In the advantageous fan-shaped arrangement, the spacing between two adjacent metal plates 10 increases progressively from the first opening 12 to an outlet. In a particularly preferred embodiment, the metal plates are arranged to follow the linear motion of the first switching contact 4.

The first opening 12 is closed off by a closure element 15 which has a slot 16 through which the contact support 25 of this first switching contact 4 extends. Unlike the housing 14 of the arc quenching chamber 9, the closure element 15 is formed of thermoplastic material. While the housing 14 of the arc quenching chamber 9 withstands the high temperatures produced in the vicinity of an arc without melting, material of the closure element 15 formed of thermoplastic material is intentionally removed by the arc. The energy produced by the arc evaporates a small predeterminable fraction of the surface of the closure element 15, producing a local overpressure which helps to drive the arc and the generated ionized gases towards at least one outlet arranged in the wall on the arc quenching chamber 9 to vent the ionized gases. The at least one outlet is not illustrated in the diagrams of the arc quenching chamber 9 in FIGS. 1 and 2; however, its approximate position is indicated by the arrow 22. The outlet is arranged in the region of a clamping screw tunnel 23 which in the present embodiment of an arc quenching chamber 9 forms a part of that chamber.

The closure element 15 has, in addition to the slot 16, corresponding receptacles 24 which are essentially arranged parallel to the slot 16 and/or parallel to the linear motion of the first switching contact 4, with at least one conductor plate 21 being arranged in each of the recesses 24. These conductor plates 21, which are preferably implemented to contain iron, generate an electromotive force during a disconnect operation, thereby further accelerating the contact support 25 of the first switching contact during its movement inside the slot 16 and hence supporting rapid opening of the switching contacts 4.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein.

What is claimed is:

1. A switching device, comprising:

an input terminal and an output terminal for connection to electrical conductors;

a first switching contact configured as a movable switching contact and a second switching, with the switching contacts, when closed, closing a current path between the input terminal and the output terminal;

a disconnect device operable to disconnect the first switching contact and the second switching contact;

an arc quenching chamber arranged in a region of the first and second switching contacts and having a first opening in a first region, with the first switching contact passing through the first opening and a plurality of metal plates, with at least two of the plurality of metal plates abutting one another at least over a region, a closure element arranged in the first region of the first opening and being formed of thermoplastic material, with the closure element having a slot oriented substantially perpendicular to the plurality of metal plates and at least one recess arranged substantially parallel to the slot, and at least one conductor plate arranged in each of the at least one recesses.

2. The switching device of claim 1, wherein the metal plates are arranged inside the arc quenching chamber in a fan-shaped configuration.

3. The switching device of claim 1, wherein the second switching contact is configured as a stationary switching contact, and the arc quenching chamber is arranged in a region of the second switching contact.

4. The switching device of claim 3, wherein the at least two metal plates abutting one another are located closest to the second switching contact.

5. The switching device of claim 1, wherein the first switching contact is configured as a movable switching contact, and the metal plates are arranged to follow the linear motion of the first switching contact.

6. The switching device of claim 1, wherein the metal plates include a U-shaped recess.

7. The switching device of claim 1, wherein the arc quenching chamber comprises at least one outlet for venting ionized gases.

8. The switching device of claim 1, wherein the arc quenching chamber comprises at least one outlet for venting ionized gases, and wherein a spacing between two adjacent metal plates progressively increases from the first opening to the outlet.

9. The switching device of claim 1, wherein the arc quenching chamber comprises a housing formed of a thermoset.

10. The switching device of claim 9, wherein the housing has openings for receiving the metal plates.

11. The switching device of claim 1, wherein the switching device is implemented as a circuit breaker.

12. The switching device of claim 1, wherein the at least one conductor plate comprises iron.

* * * * *